US010271647B2

(12) United States Patent
Huang

(10) Patent No.: US 10,271,647 B2
(45) Date of Patent: Apr. 30, 2019

(54) WORK CHAIR WITH ADJUSTABLE TRAY

(71) Applicant: HIEVER CO., LTD., Taichung (TW)

(72) Inventor: Tony Huang, Taichung (TW)

(73) Assignee: HIEVER CO., LTD., Taichung (TW)

( * ) Notice: Subject to any disclaimer, the term of this patent is extended or adjusted under 35 U.S.C. 154(b) by 25 days.

(21) Appl. No.: 15/591,647

(22) Filed: May 10, 2017

(65) Prior Publication Data

US 2017/0332784 A1 Nov. 23, 2017

(30) Foreign Application Priority Data

May 17, 2016 (TW) ..... 105207180 U

(51) Int. Cl.

| | |
|---|---|
| ***A47B 83/02*** | (2006.01) |
| ***A47B 5/02*** | (2006.01) |
| ***A47B 83/04*** | (2006.01) |
| ***A47C 7/00*** | (2006.01) |
| ***A47C 7/62*** | (2006.01) |
| ***A47C 9/02*** | (2006.01) |

(52) U.S. Cl.

CPC ..... *A47B 83/02* (2013.01); *A47B 5/02* (2013.01); *A47B 83/045* (2013.01); *A47C 7/006* (2013.01); *A47C 7/62* (2013.01); *A47C 9/02* (2013.01)

(58) Field of Classification Search

None

See application file for complete search history.

(56) References Cited

U.S. PATENT DOCUMENTS

| | | | | |
|---|---|---|---|---|
| 2,798,732 | A * | 7/1957 | Craig | A01G 20/30 280/641 |
| D353,058 | S | 12/1994 | Dallas | |
| D415,359 | S * | 10/1999 | Boyd | D6/336 |
| 7,661,685 | B2 * | 2/2010 | Thibault | B25H 3/00 280/47.35 |
| 9,687,080 | B1 * | 6/2017 | Thiel | A47C 9/10 |
| 2004/0160150 | A1 * | 8/2004 | Hay | A47B 97/00 312/281 |
| 2007/0236059 | A1 * | 10/2007 | Hardt, II | A47C 3/18 297/188.11 |
| 2009/0127989 | A1 * | 5/2009 | Liuhong | B25H 3/00 312/235.5 |
| 2011/0192810 | A1 * | 8/2011 | Kao | B25H 3/028 211/70.6 |
| 2012/0061930 | A1 * | 3/2012 | Lin | B25H 3/02 280/47.35 |

(Continued)

*Primary Examiner* — Paul N Dickson
*Assistant Examiner* — Hilary L Johns
(74) *Attorney, Agent, or Firm* — Muncy, Geissler, Olds & Lowe, P.C.

(57) ABSTRACT

A work chair includes a chair body, a plurality of wheel sets mounted at the bottom side of the chair body, a seat cushion mounted at the top side of the peripheral wall of the chair body, two guide rails mounted at the chair body at one lateral side each defining a longitudinal sliding slot and locating notch in communication with the sliding slot, a tray, a pivot bolt pivotally connecting the tray to the sliding slots of the rail for allowing the tray to be moved along the sliding slots of the guide rails and having an engagement portion for selectively engaging in one locating notch of each guide rail to hold the tray positively at the selected elevational position for carrying tools.

20 Claims, 7 Drawing Sheets

(56) References Cited

U.S. PATENT DOCUMENTS

| | | | | |
|---|---|---|---|---|
| 2013/0062300 | A1* | 3/2013 | Drake | A47B 57/34 211/183 |
| 2015/0097348 | A1* | 4/2015 | Steinfels | B62B 3/02 280/47.35 |
| 2016/0166070 | A1* | 6/2016 | Golic | A45C 11/20 206/216 |
| 2016/0353887 | A1* | 12/2016 | Lu | A47B 83/02 |
| 2017/0014991 | A1* | 1/2017 | Fuentes | B25H 5/00 |
| 2017/0164751 | A1* | 6/2017 | Huang | A47C 7/62 |
| 2017/0232988 | A1* | 8/2017 | Bernier | B62B 3/005 280/47.35 |
| 2018/0084913 | A1* | 3/2018 | Matsumoto | A47D 1/004 |

* cited by examiner

WORK CHAIR WITH ADJUSTABLE TRAY

BACKGROUND OF THE INVENTION

1. Field of the Invention

The present invention relates to supplementary work chairs for use in maintenance works and more particularly, to such a work chair, which is equipped with an adjustable tool tray.

2. Description of the Related Art

In general, in order to facilitate a maintenance mechanic (such as: vehicle maintenance mechanic, machine maintenance mechanic or equipment maintenance mechanic) performing maintenance and accessing to related maintenance tools during maintenance work, a work chair will be used. USD353058 discloses a work chair, which comprises a support frame, a seat cushion mounted at the top side of the support frame, a bottom block mounted at the opposing bottom side of the support frame, wheels mounted at the bottom side of the bottom block, and a tray mounted at the top side of the bottom block for carrying tools. Thus, the maintenance mechanic can sit on the work chair, move with the work chair, and carry tools on the tray during a maintenance work.

However, the aforesaid prior art work chair is still not satisfactory in function. For example, the overall structure of the work chair is fixed, when the maintenance mechanic is going to pick up one maintenance tool from the tray, the maintenance mechanic may need to bend the body over a large angle to access to the object or maintenance tool that is disposed near a rear side of the tray. Beside the problem that the tray structure makes it difficult for the maintenance mechanic to take maintenance tools, another problem is that the elevation of the tray is not adjustable according to the body size of the user. An improvement in this regard is desired.

SUMMARY OF THE INVENTION

The present invention has been accomplished under the circumstances in view. It is the main object of the present invention to provide a work chair, which is equipped with a tray for carrying maintenance tools that can be conveniently adjusted to the desired elevational position according to the user's personal body size, facilitating maintenance performance.

To achieve this and other objects of the present invention, a work chair comprises a chair body, a plurality of wheel sets, a seat cushion, two guide rails, a tray and a stopper member. The chair body comprises a bottom block, a peripheral wall upwardly extended from the border of the bottom block, an accommodation chamber surrounded by the bottom block and the peripheral wall, and an opening disposed in communication with the accommodation chamber for easy access to the inside of the accommodation chamber for arranging tools. The plurality of wheel sets are respectively mounted at the bottom side of the bottom block of the chair body, enabling relatively easy rolling movement of the chair body. The seat cushion is mounted at the topmost edge of the peripheral wall of the chair body and spaced right above the bottom block. The guide rails are mounted at the outer surface of the peripheral wall of the chair body at one lateral side, each comprising a sliding slot extending along the length thereof and a plurality of locating notches extended from the sliding slot at an angle. The locating notches of the guide rails are disposed in a symmetric manner. The tray is pivotally coupled to the sliding slots of the guide rails with an elongated pivot bolt, an elongated pivot bolt that comprises an engagement portion engageable in one respective locating notch of each guide rail to hold the tray in an elevational position corresponding to the elevation of the selected locating notches. The stopper members are respectively mounted at an outer side of the peripheral wall of the chair body adjacent to the guide rails, and respectively protruding toward the locating notches of the respective guide rails for stopping against the top edge of the tray in the selected locating notches for carrying tools.

Preferably, the work chair further comprises a protective member mounted at the bottom block of the chair body and extended from the bottom block toward the guide rails, and adapted for stopping the tray from falling out of the guide rails. Preferably, the work chair further comprises a tool rack mounted at the peripheral wall of the chair body remote from the opening. The tool rack extends in direction away from the peripheral wall, comprising a plurality of through holes of different shapes and sizes for the setting of corresponding tools.

Other advantages and features of the present invention will be fully understood by reference to the following specification in conjunction with the accompanying drawings, in which like reference signs denote like elements, components, objects, structures, systems, architectures, devices, processes, methods, or steps.

DETAILED DESCRIPTION OF THE INVENTION

Figure 1:
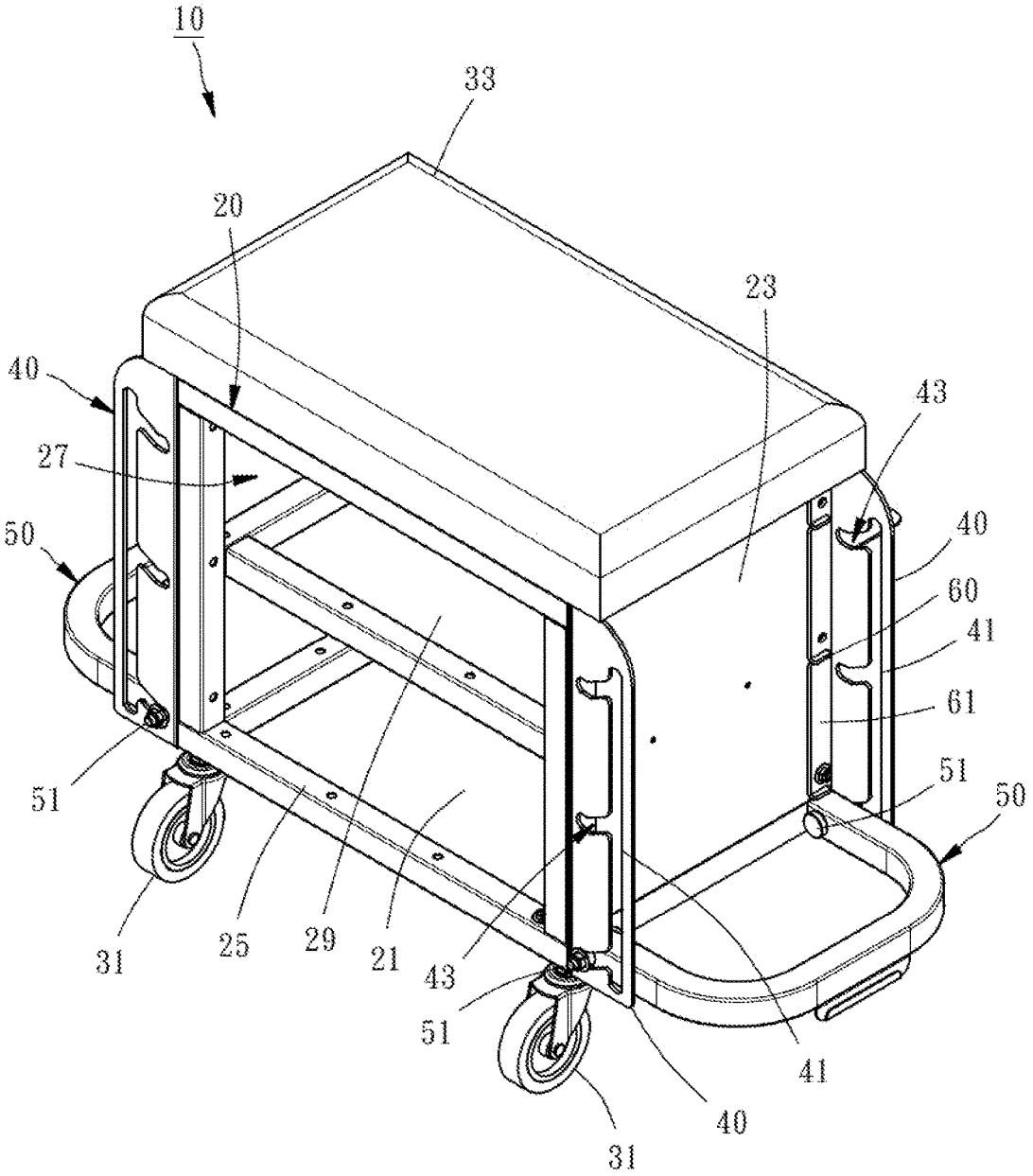
FIG. 1 is an oblique top elevational view of a work chair in accordance with a first embodiment of the present invention.
Figure 2:
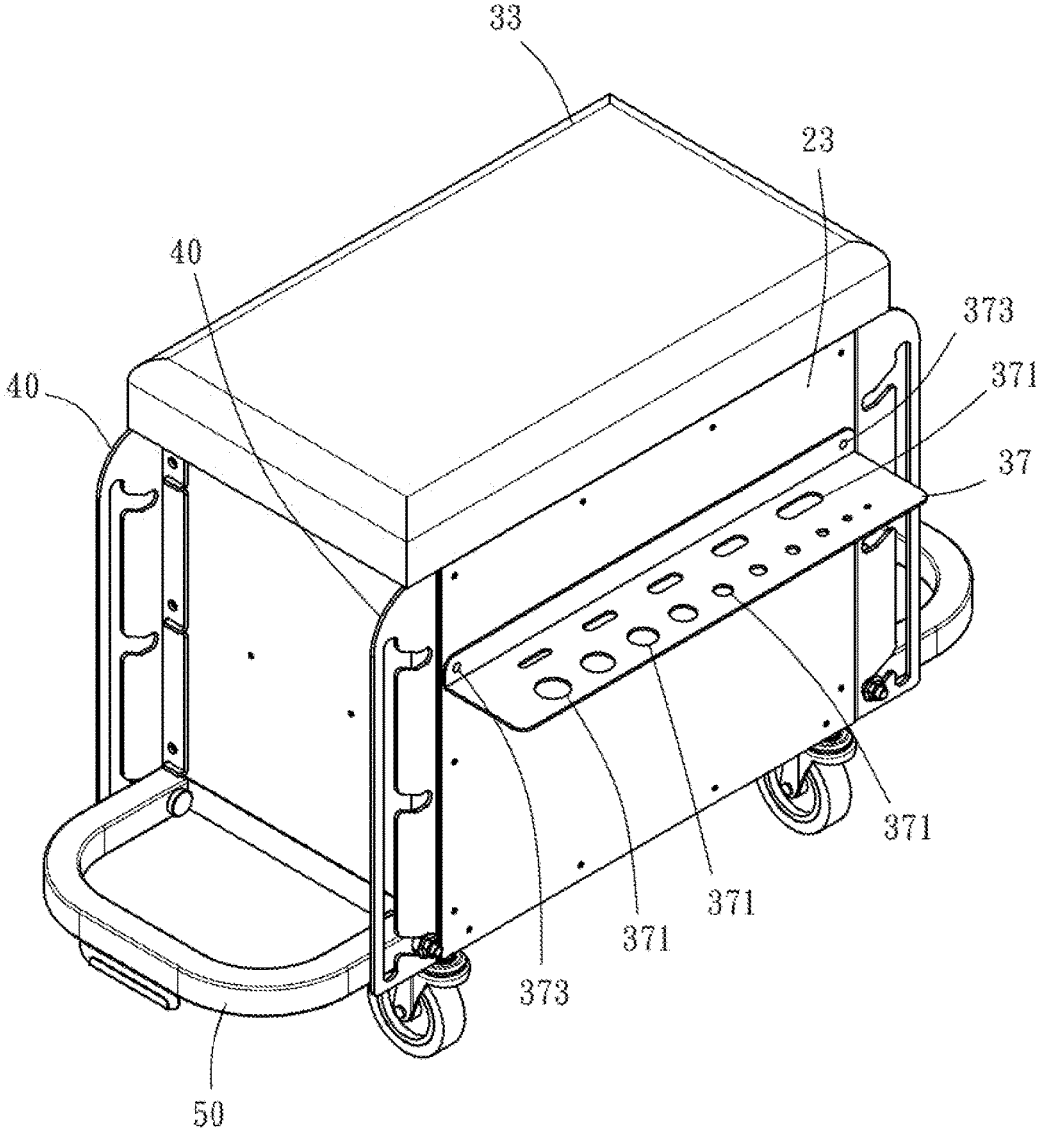
FIG. 2 corresponds to FIG. 2 when viewed from another angle.
Figure 3:
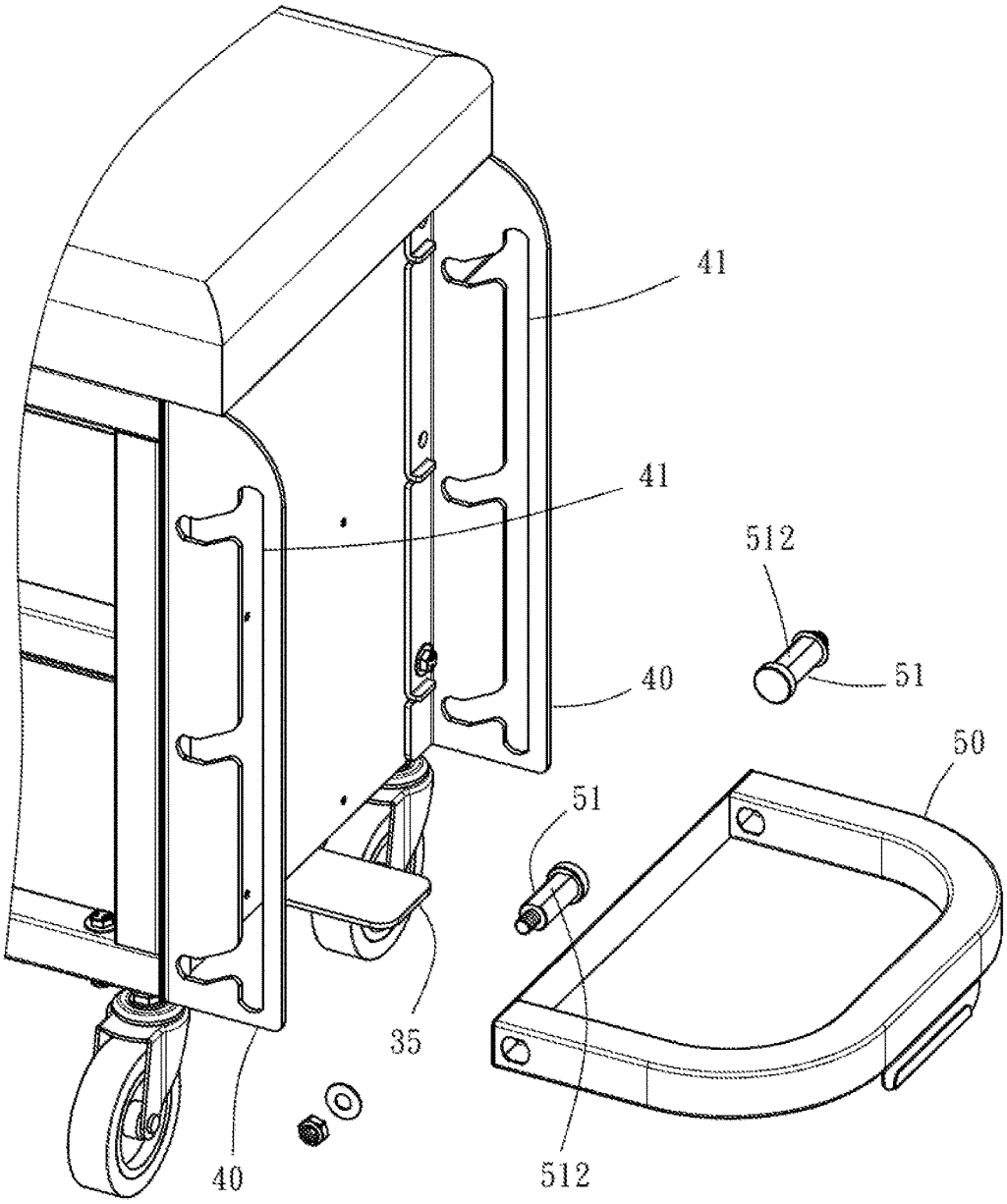
FIG. 3 is an exploded view of a part of the work chair in accordance with the first embodiment of the present invention.
Figure 4:
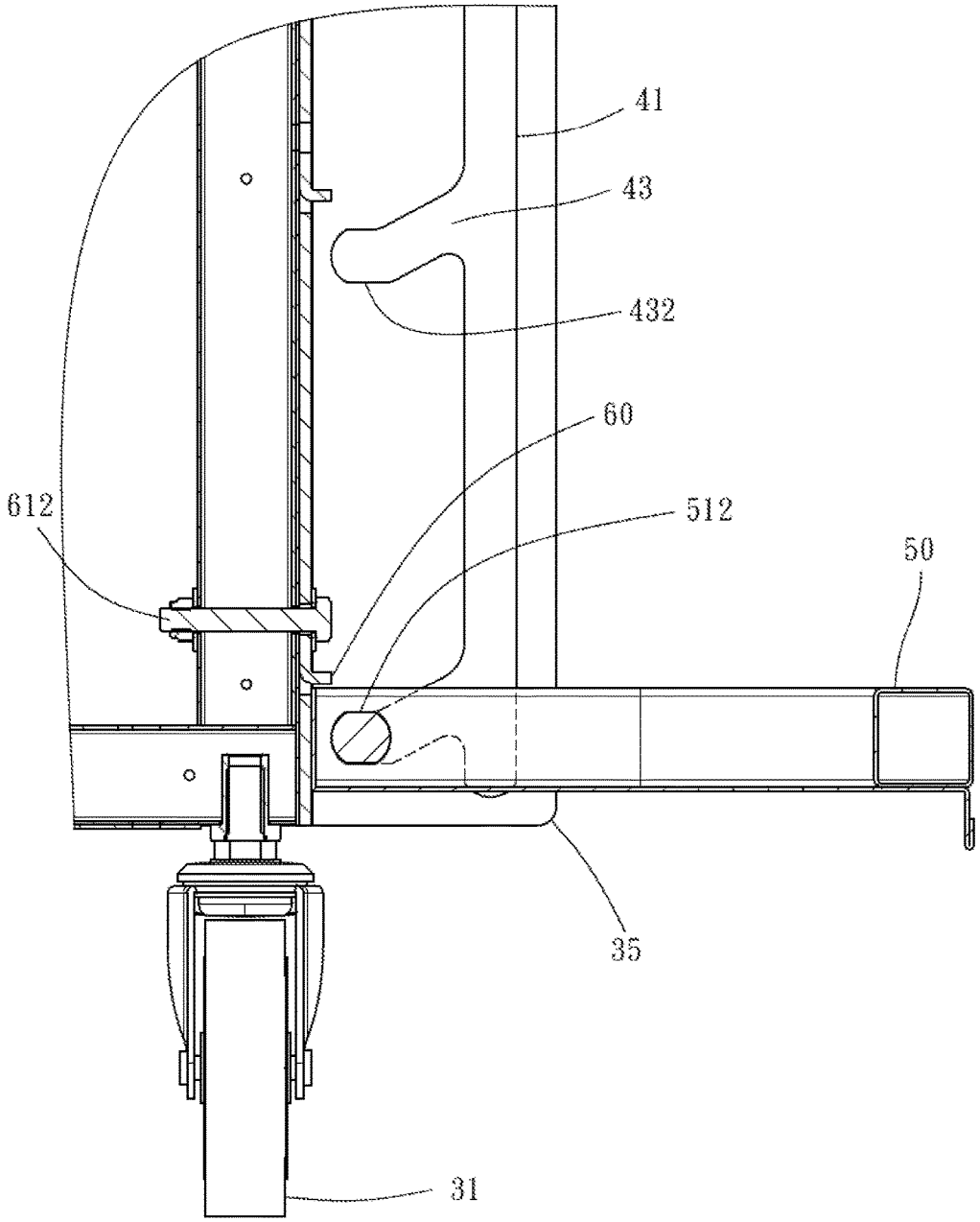
FIG. 4 is a schematic enlarged view of a part of the work chair in accordance with the first embodiment of the present invention.

Referring to FIGS. 1-4, a work chair 10 in accordance with a first embodiment of the present invention is shown. The work chair 10 comprises a chair body 20, four wheel sets 31, a seat cushion 33, at least one protective member 35, a tool rack 37, at least one pair of guide rails 40, at least one tray 50 and at least one stopper member 60.

The chair body 20 comprises a bottom block 21, a peripheral wall 23 extended around the border of the bottom block 21, an accommodation chamber 25 surrounded by the bottom block 21 and the peripheral wall 23, and an opening 27 in communication with the accommodation chamber 25. In this embodiment, the chair body 20 further comprises at least one partition panel 29 mounted in the accommodation chamber 25 and connected to an inner surface of the peripheral wall 23 to divide the accommodation chamber 25 into multiple accommodation spaces for storage of tools in a classified manner.

The four wheel sets 31 are respectively mounted to a bottom side of the bottom block 21 of the chair body 20, enabling relatively easy rolling movement of the chair body 20. In this embodiment four wheel sets 31 are used, however, this arrangement is not a limitation, two or three or five wheel sets 31 can be used according to different requirements to achieve the same effects.

The seat cushion 33 is mounted at the topmost edge of the peripheral wall 23 of the chair body 20. In this embodiment, the seat cushion 33 is spaced right above the bottom block 21 of the chair body 20.

The protective member 35 is mounted at the bottom block 21 of the chair body 20.

The tool rack 37 is mounted at the peripheral wall 23 of the chair body 20. Further, the tool rack 37 is disposed in the same axial direction as the same bottom block 21 and extends away from the peripheral wall 23 to a certain distance, comprising a plurality of through holes 371 of different shapes and sizes for the setting of corresponding tools. In this embodiment, two tenones 373 are inserted through the peripheral wall 23 of the chair body 20 to affix the tool rack 37 to the chair body 20.

The guide rails 40 are vertically mounted at an outer side of the peripheral wall 23 of the chair body 20, each comprising a sliding slot 41 extending along the length thereof and a plurality of locating notches 43. The locating notches 43 of the two guide rails 40 are arranged in a symmetrical manner and disposed in communication with the respective sliding slots 41. In this embodiment, the two guide rails 40 are symmetrically mounted to the peripheral wall 23 of the chair body 20 at two opposite lateral sides; each guide rail 40 comprises three locating notches 43; the three locating notches 43 at one guide rail 40 at one lateral side of the chair body 20 respectively face toward the three locating notches 43 at the other guide rail 40 at the same lateral side of the chair body 20; the locating notches 43 are respectively disposed in communication with the respective sliding slots 41; each locating notch 43 comprises a position-limiting section 432 that is a flat section. Each protective member 35 extends from one side of the bottom block 21 in direction toward the two guide rails 40 at one lateral of the chair body 20 to a certain distance. The tool rack 37 is disposed adjacent to one respective guide rail 40 at each of the two opposite lateral sides of the chair body 20.

Each tray 50 comprises two pivot bolts 51 located two opposite lateral sides thereof and respectively slidably mounted in the sliding slots 41 of the two guide rails 40 at one lateral side of the chair body 20, each comprising an engagement portion 512. By means of the pivot bolts 51, each tray 50 can be selectively moved along the respective sliding slots 41 to one of a series of elevational positions corresponding to the locating notches 43, and then the engagement portions 512 of the pivot bolts 51 are forced into the respective position-limiting sections 432 of the respective locating notches 43 to hold the tray 50 positively in the selected elevational position. In this embodiment, as stated above, two trays 50 are mounted at the peripheral wall 23 of the chair body 20 at two opposite lateral sides; the two pivot bolts 51 of each tray 50 are respectively slidably mounted in the sliding slots 41 of the two guide rails 40 at one respective lateral side of the chair body 20; the engagement portion 512 has a flat section of width equal to the width of the position-limiting section 432 of each locating notch 43, thus, when the engagement portions 512 the two pivot bolts 51 of one tray 50 are respectively engaged into the position-limiting sections 432 of the respective locating notches 43, the tray 50 is prohibited from rotation or displacement relative to the chair body 20.

The at least one stopper member 60 is respectively mounted at an outer side of the peripheral wall 23 of the chair body 20 adjacent to the guide rails 40, and protruded from the peripheral wall 23 toward the position-limiting sections 432 of the locating notches 43 of the guide rails 40 at an upper side relative to the respective position-limiting sections 432. When the two engagement portions 512 of the tray 50 are engaged in the respective position-limiting sections 432 of the two respective locating notches 43, a top side of the tray 50 is stopped against at least one stopper member 60. Each stopper member 60 comprises a mounting portion 61 affixed to the peripheral wall 23 of the chair body 2. In this embodiment, two guide rails 40 are mounted at the peripheral wall 23 of the chair body 20 at each of the two opposite lateral sides of the chair body 20; multiple stopper members 60 are mounted at the peripheral wall 23 and respectively disposed adjacent to the respective guide rails 40; these stopper members 60 protrude from the peripheral wall 23 to a predetermined distance in the same axial direction relative to the respective position-limiting sections 432 of the guide rail 40; Preferably, the mounting portion 61 of each stopper member 60 is affixed to the peripheral wall 23 of the chair body 20 with tenones 612 (including, but not limited to, screws or rivets).

When compared to prior art techniques, the effects and features of the first embodiment of the present invention are as follows:

1. When a maintenance mechanic uses the work chair and undertakes a maintenance work, the maintenance personal can more convenient store and access to the relevant maintenance tools. Referring to FIGS. 1 and 4 again, the maintenance mechanic can adjust the two trays 50 relative to the chair body 20 of the work chair 10 to the desired elevation according to personal body size. Since the engagement portions 512 of the pivot bolts 51 of the tray 50 are flat-shaped and have a width equal to the width of the position-limiting sections 432 of the locating notches 43 of the guide rails 40, the tray 50 can be positively held in the selected elevational position without rotation or displacement after engagement of the engagement portions 512 into the position-limiting sections 432 of the selected locating notches 43 of the respective guide rails 40, and thus, the maintenance mechanic can store and access to the relevant maintenance tools conveniently. Preferably, the relevant component parts are so configured that the top edge of each tray 50 can be stopped against the respective stopper member 60 after adjusted to the selected elevational position.

Figure 5:
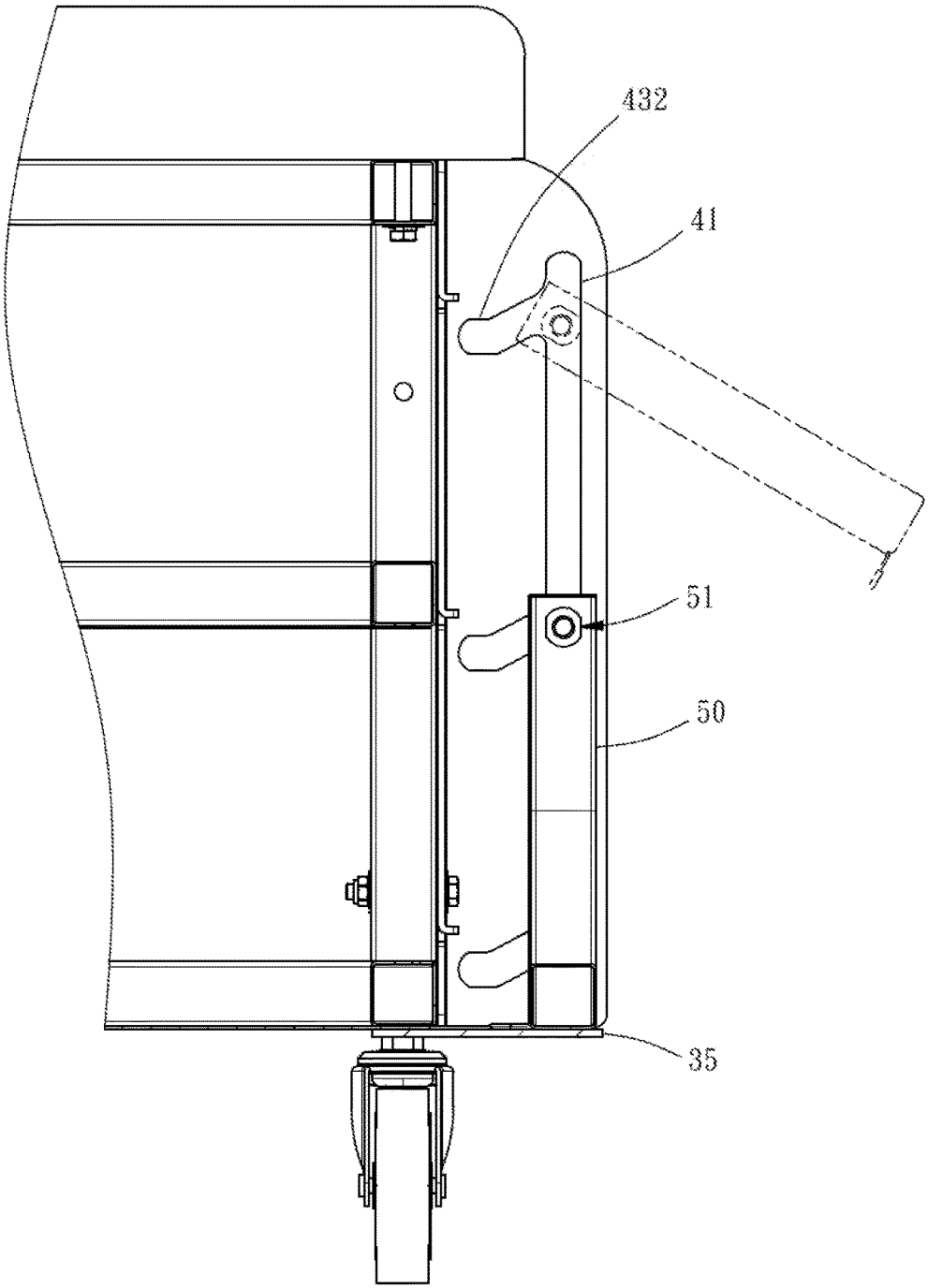
FIG. 5 is a schematic applied view of the work chair in accordance with a first embodiment of the present invention.

2. The design of the present invention greatly prolongs the service life of the tray 50 for carrying relevant maintenance tools. Referring also to FIG. 5, the protective members 35 are mounted at the bottom block 21 of the chair body 20 of the work chair 10; if the tray 50 falls down accidentally due to that the engagement portions 512 of the pivot bolts 51 of the tray 50 are not accurately engaged in the respective position-limiting sections 432 of the respective guide rails 40, the falling tray 50 will be stopped by the respective protective member 35 and will not fall to the floor; and thus the service life of the tray 50 can be prolonged.

The technical features and the effects of the first preferred embodiment of the present invention are described above, and the technical features and effects of a work chair in accordance with a second preferred embodiment of the present invention will be outlined hereinafter.

Figure 6:
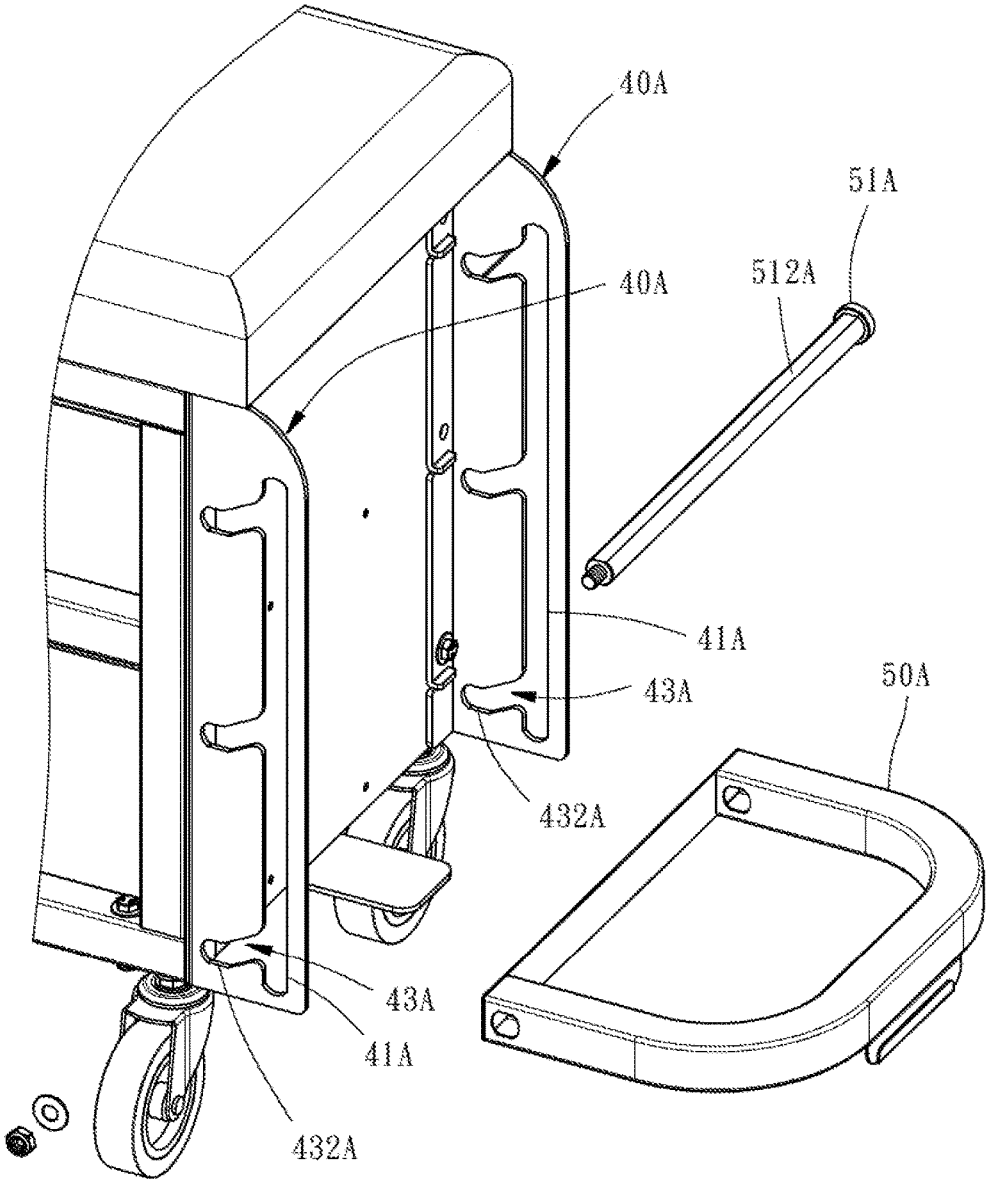
FIG. 6 is an exploded view of a part of a work chair in accordance with a second embodiment of the present invention.

Referring to FIG. 6, a work chair in accordance with the second preferred embodiment of the present invention is shown. This second embodiment is substantially similar to the aforesaid first embodiment with the exceptions as follows:

The tray 50A is slidably and pivotally coupled to the sliding slots 41A of the respective two guide rails 40A by an elongated pivot bolt 51A that can be moved along the respective sliding slots 41A; similarly, the engagement portion 512A of the elongated pivot bolt 51A is flat-shaped.

In application of this second embodiment, when the pivot bolt 51A of one tray 50A is moved out of the respective two sliding slots 41A into one symmetric pair of locating notches 43A, subject to the design that the width of the position-limiting sections 432A of the locating notches 43A of the guide rails 40A is equal to the width of the engagement portions 512A of the trays 50A, the engagement portion 512A of the pivot bolt 51A can be smoothly and positively engaged into the respective position-limiting sections 432A of the respective locating notches 43A to hold the tray 50A positively in the selected position for receiving relevant maintenance tools for convenient use.

The technical features and the effects of the second preferred embodiment of the present invention are described above, and the technical features and effects of a work chair in accordance with a third preferred embodiment of the present invention will be outlined hereinafter.

Figure 7:
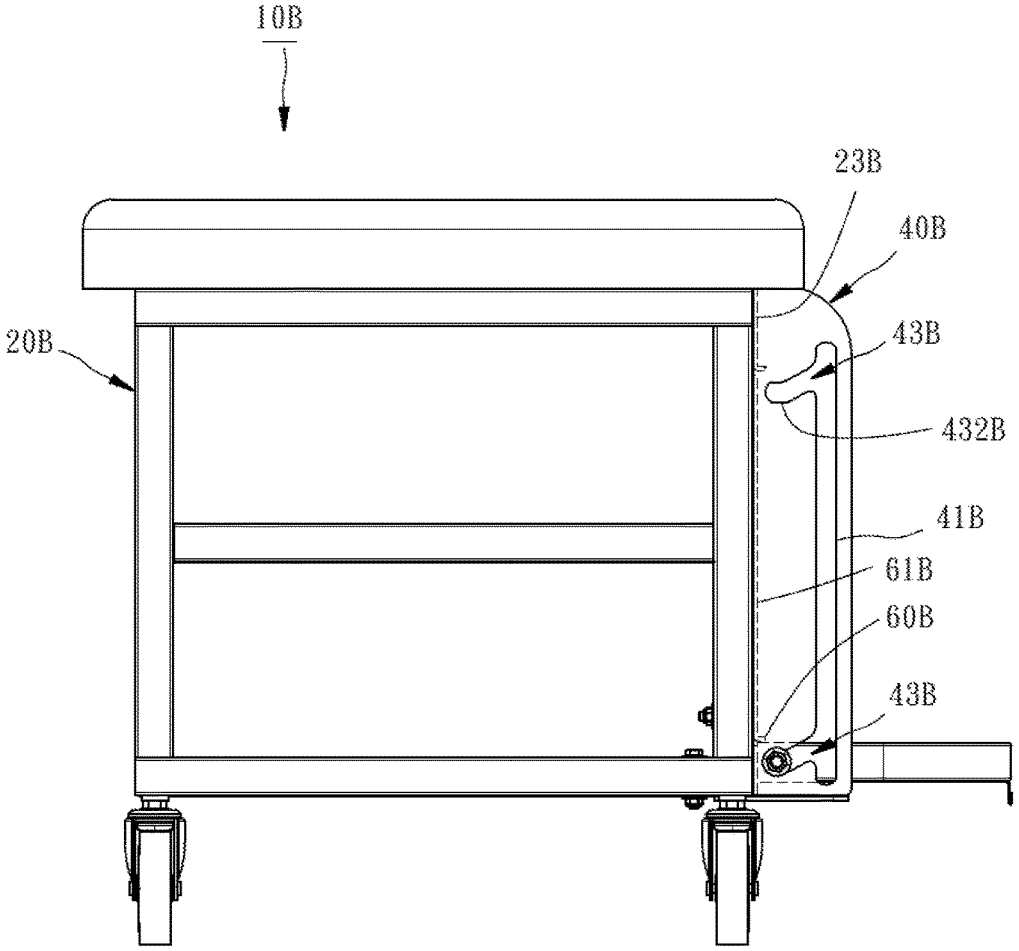
FIG. 7 is a schematic side view of a work chair in accordance with a third embodiment of the present invention.

Referring to FIG. 7, a work chair 10B in accordance with the third preferred embodiment of the present invention is shown. This third embodiment is substantially similar to the aforesaid first and second embodiments with the exceptions as follows:

Only two guide rails 40B are mounted at the peripheral wall 23B of the chair body 20B at one lateral side. The guide rails 40B each provide a sliding slot 41B, and two locating notches 43B respectively disposed near opposing top and bottom ends thereof in communication with the respective sliding slot 41B.

In this third embodiment, similar to the aforesaid first and second embodiments, the sliding slots 41B vertically extend along the length of the respective guide rails 40B; the guide rails 40B are respectively disposed near the respective stopper members 60B at the peripheral wall 23B; the stopper members 60B respectively protrude from the peripheral wall 23B toward the respective position-limiting sections 432B of the respective guide rails 40B to a predetermined distance; the stopper members 60B have the respective mounting portions 61B affixed to the peripheral wall 23B of the chair body 20B.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A work chair, comprising:

a chair body comprising bottom block, a peripheral wall upwardly extended around said bottom block, an accommodation chamber surrounded by said bottom block and said peripheral wall and an opening located in one side in communication with said accommodation chamber;

a plurality of wheel sets respectively mounted to a bottom side of said bottom block of said chair body and adapted for enabling relatively easy rolling movement of said chair body;

a seat cushion mounted at the topmost edge of said peripheral wall of said chair body and spaced right above said bottom block;

at least one pair of guide rails mounted at said peripheral wall of said chair body at at least one of two opposite lateral sides of said chair body, each said guide rail comprising a sliding slot extending along the length thereof and a plurality of locating notches extended from said sliding slot at an angle, the said locating notches of each pair of said guide rails being disposed in a symmetric manner;

at least one tray, each said track being pivotally coupled to the said sliding slots of the said two guide rails at one lateral side of said chair body with an elongated pivot bolt, said elongated pivot bolt comprising an engagement portion engageable in one respective locating notch of each of the two said guide rails at one lateral side of said chair body to hold the associating said tray in an elevational position corresponding to the elevation of the selected said locating notches; and at least one stopper member respectively mounted at an outer side of said peripheral wall of said chair body adjacent to one respective pair of said guide rails, each said stopper member protruding from said peripheral wall toward the said locating notches of one respective said guide rail for stopping against a top edge of one said tray in the selected said locating notches for carrying tools.

2. The work chair as claimed in claim 1, wherein said chair body further comprises at least one partition panel mounted in said accommodation chamber and connected to an inner surface of said peripheral wall to divide said accommodation chambers into multiple accommodation spaces for storage of tools in a classified manner.

3. The work chair as claimed in claim 2, further comprising at least one protective member mounted at said bottom block of said chair body and respectively extended from said bottom block toward the respective said guide rails at the two opposite lateral sides of said chair body and adapted for stopping one respective said tray from falling out of said guide rails.

4. The work chair as claimed in claim 1, further comprising at least one protective member mounted at said bottom block of said chair body and respectively extended from said bottom block toward the respective said guide rails at the two opposite lateral sides of said chair body and adapted for stopping one respective said tray from falling out of said guide rails.

5. The work chair as claimed in claim 4, further comprising a tool rack mounted at said peripheral wall of said chair body adjacent to one respective said guide rail at each of two opposite lateral sides of said chair body remote from said opening, said tool rack extending in direction away from said peripheral wall and comprising a plurality of through holes of different shapes and sizes for the setting of corresponding tools.

6. The work chair as claimed in claim 1, further comprising a tool rack mounted at said peripheral wall of said chair body adjacent to one respective said guide rail at each of two opposite lateral sides of said chair body remote from said opening, said tool rack extending in direction away from said peripheral wall and comprising a plurality of through holes of different shapes and sizes for the setting of corresponding tools.

7. The work chair as claimed in claim 1, wherein each said stopper member comprises a mounting portion affixed to an outer surface of said peripheral wall of said chair body.

8. The work chair as claimed in claim 1, wherein the said engagement portion of said elongated pivot bolt of each said tray is flat-shaped.

9. The work chair as claimed in claim 8, wherein each said locating notch of each said guide rail comprises a position-limiting section having a flat shape and a width equal to the flat-shaped said engagement portion of said elongated pivot bolt, said position-limiting section being adapted for receiving said engagement portion of said elongated pivot bolt and prohibiting said engagement portion of said elongated pivot bolt from rotation.

10. The work chair as claimed in claim 9, wherein each said stopper member is disposed at a top side relative to one said position-limiting section of one said guide rail.

11. A work chair, comprising:

a chair body comprising bottom block, a peripheral wall upwardly extended around said bottom block, an accommodation chamber surrounded by said bottom block and said peripheral wall and an opening located in one side in communication with said accommodation chamber;

a plurality of wheel sets respectively mounted to a bottom side of said bottom block of said chair body and adapted for enabling relatively easy rolling movement of said chair body;

a seat cushion mounted at the topmost edge of said peripheral wall of said chair body and spaced right above said bottom block;

at least one pair of guide rails mounted at said peripheral wall of said chair body at at least one of two opposite lateral sides of said chair body, each said guide rail comprising sliding slot extending along the length thereof and a plurality of locating notches extended from said sliding slot at an angle, the said locating notches of the said at least one pair of said guide rail being disposed in a symmetric manner;

at least one tray, each said track comprising two pivot bolts located at two opposite lateral sides thereof and pivotally coupled to the said sliding slots of the said two guide rails at one respective lateral side of said chair body, each said pivot bolt comprising an engagement portion engageable in one respective locating notch of one respective said guide rail to hold the associating said tray in an elevational position corresponding to the elevation of the selected said locating notch; and at least one stopper member respectively mounted at an outer side of said peripheral wall of said chair body adjacent to one respective pair of said guide rails, each said stopper member protruding from said peripheral wall toward the said locating notches of one respective said guide rail for stopping against a top edge of one said tray in the respective said locating notches.

12. The work chair as claimed in claim 11, wherein said chair body further comprises at least one partition panel mounted in said accommodation chamber and connected to an inner surface of said peripheral wall to divide said accommodation chambers into multiple accommodation spaces for storage of tools in a classified manner.

13. The work chair as claimed in claim 12, further comprising at least one protective member mounted at said bottom block of said chair body and respectively extended from said bottom block toward the respective said guide rails at the two opposite lateral sides of said chair body and adapted for stopping one respective said tray from falling out of said guide rails.

14. The work chair as claimed in claim 11, further comprising at least one protective member mounted at said bottom block of said chair body and respectively extended from said bottom block toward the respective said guide rails at the two opposite lateral sides of said chair body and adapted for stopping one respective said tray from falling out of said guide rails.

15. The work chair as claimed in claim 14, further comprising tool rack mounted at said peripheral wall of said chair body adjacent to one respective said guide rail at each of two opposite lateral sides of said chair body remote from said opening, said tool rack extending in direction away from said peripheral wall and comprising a plurality of through holes of different shapes and sizes for the setting of corresponding tools.

16. The work chair as claimed in claim 11, further comprising a tool rack mounted at said peripheral wall of said chair body adjacent to one respective said guide rail at each of two opposite lateral sides of said chair body remote from said opening, said tool rack extending in direction away from said peripheral wall and comprising a plurality of through holes of different shapes and sizes for the setting of corresponding tools.

17. The work chair as claimed in claim 11, wherein each said stopper member comprises a mounting portion affixed to an outer surface of said peripheral wall of said chair body.

18. The work chair as claimed in claim 11, wherein the said engagement portion of said elongated pivot bolt of each said tray is flat-shaped.

19. The work chair as claimed in claim 18, wherein each said locating notch of each said guide rail comprises a position-limiting section having a flat shape and a width equal to the flat-shaped said engagement portions of said pivot bolts, said position-limiting section being adapted for receiving said engagement portion of one respective said pivot bolt and prohibiting the said engagement portion of the respective said pivot bolt from rotation.

20. The work chair as claimed in claim 19, wherein each said stopper member is disposed at a top side relative to one said position-limiting section of one said guide rail.

* * * * *